US006164039A

United States Patent [19]

Ram et al.

[11] Patent Number: 6,164,039

[45] **Date of Patent: *Dec. 26, 2000**

[54] METHOD OF IMPROVING THE RAW STOCK KEEPING OF PHOTOTHERMOGRAPHIC FILMS

[75] Inventors: Arunachalam T. Ram; Leann L. Wilson; Donald L. Kerr, all of Rochester, N.Y.

[73] Assignee: Eastman Kodak Company, Rochester, N.Y.

[ * ] Notice: This patent is subject to a terminal disclaimer.

[21] Appl. No.: 09/158,874

[22] Filed: Sep. 18, 1998

[51] Int. Cl.[7] ..... B65B 29/00

[52] U.S. Cl. ..... 53/400; 53/428; 53/472; 430/347

[58] Field of Search ..... 53/400, 401, 402, 53/428, 472; 206/205; 430/347

[56] References Cited

U.S. PATENT DOCUMENTS

| | | | |
|---|---|---|---|
| 3,356,280 | 12/1967 | Dunholter | 206/205 |
| 4,036,360 | 7/1977 | Deffeyes . | |
| 5,189,581 | 2/1993 | Schroder et al. . | |
| 5,195,302 | 3/1993 | Collantes et al. | 53/472 |
| 5,215,192 | 6/1993 | Ram et al. . | |
| 5,683,662 | 11/1997 | Hollinger, Jr. . | |
| 5,789,044 | 8/1998 | Ram et al. . | |
| 5,846,696 | 12/1998 | Ram et al. . | |

OTHER PUBLICATIONS

WPI Abstract Acc. No. 93–354187/45 & JP 5257238
WPI Abstract Acc. No. 82–51503E/25 & JP 57078944

*Primary Examiner*—Linda Johnson
*Attorney, Agent, or Firm*—Paul A. Leipold

[57] ABSTRACT

The invention relates to a method of improving raw stock keeping of silver containing imaging material comprising providing a package of said material and providing in said package a fiber board containing zeolite.

13 Claims, No Drawings

METHOD OF IMPROVING THE RAW STOCK KEEPING OF PHOTOTHERMOGRAPHIC FILMS

FIELD OF THE INVENTION

This invention relates to a method and article for improving the storage of materials subject to deterioration by water vapor absorption or solvents or absorption of gases such as $SO_2$ or ozone. It particularly relates to storage of raw photothermographic films.

BACKGROUND OF THE INVENTION

The ability to store processed and unprocessed photographic film without change in the properties of the film is important to maintaining exposed and developed films, as well as maintaining consistent performance of unexposed films. The archival keeping properties of photographic films are expected to be measured in decades. The properties of unexposed films are intended to remain stable over many months of storage in various conditions.

It is common practice to use hermetically sealed containers of plastic or metal, or to seal in metal coated polymer bags to prevent moisture access to films. It is also desirable to protect films from gases such as $SO_2$ and ozone. Other materials such as food also need sealed and protective packaging. This is commonly referred to as Modified Atmosphere Packaging (MAP). This is where you create a specific ambient condition within a package different than typical ambient atmospheric condition.

Further, it has been disclosed in U.S. Pat. No. 5,215,192—Ram et al that particulate materials such as molecular sieve zeolites may be placed in film storage containers for exposed films to improve their storage properties. Desiccants also have been proposed for package insert or coating material for a package for film or cameras in U.S. Pat. No. 4,036,360—Deffeyes.

It has been proposed in U.S. Pat. No. 5,189,581—Schroder that desiccants be placed within video cameras in order to dry the cameras.

U.S. Pat. No. 5,789,044—Ram et al discloses the use of zeolite molecular materials to form a part of a structure that is utilized for storing or holding film.

It is disclosed in U.S. Pat. No. 5,633,054—Hollinger, Jr., U.S. Pat. No. 5,525,296—Hollinger, Jr., and U.S. Pat. No. 5,683,662—Hollinger, Jr. that materials such as hydrophobic molecular sieve materials may be incorporated into fiber materials. The molecular sieve materials are crystalline, hydrated metal aluminosilicates which are either made synthetically or naturally occurring minerals. Such materials are described in U.S. Pat. Nos. 2,882,243; 2882,244; 3,078,636; 3,140,235; and 4,094,652.

In packaging of unexposed photothermographic films, there has been found to be particular difficulty in that present packaging methods for such films utilized in the health care business do not result in good storage properties even though sealed in plastic film bags having a metalized layer. There is a need for improved packaging materials for such films.

However, the above systems for placing desiccants into a package suffers of from disadvantages. The desiccant packs may be difficult to dispose of. Further, the packs contain polymers which are expensive and may inhibit absorption gases to the zeolite or other humiditants. Further, they cause an inconvenience and expense in packaging in that a separate item must be added to the package, and such external elements may induce pressure sensitization of films.

PROBLEM TO BE SOLVED BY THE INVENTION

There remains a need for a method of providing packages for photothermographic films with improved desiccant and gas absorbing protection. Further, there is a need for a better method of providing photothermographic film packaging with desiccant protection.

SUMMARY OF THE INVENTION

An object of the invention is to overcome disadvantages of prior methods and articles.

A further object of the invention is to provide improved moisture protection for photographic articles.

An additional object is to provide improved storage qualities and container for storing photothermographic film materials.

These and other objects of the invention generally are accomplished by a method of improving raw stock keeping of silver containing imaging material comprising providing a package of said material and providing in said package a fiber board containing zeolite.

ADVANTAGEOUS EFFECT OF THE INVENTION

The invention provides packaging that provides moisture protection without the need for a separate package of desiccant which presents a disposal problem, as well as a packaging problem. The method of the invention further provides an integral structure that is both a structural part of the packaging, as well as providing desiccant protection. The method and articles of the invention are low in cost and provide improved film properties by allowing storage of photothermographic film materials without deterioration.

DETAILED DESCRIPTION OF THE INVENTION

The invention has the advantage that photothermographic films are generally packaged with stiffener, commonly cardboard or paperboard liners to prevent damage to the film during handling and shipping by bending or edge deterioration. The packaging method of the invention utilizes these paper fiber linerboards as the medium for carrying zeolite which will both protect the film from deterioration due to humidity changes and absorption of other gases, while also protecting the film from damage by bending and edge deterioration from handling. Therefore, the use of linerboards of the invention does not increase the packaging load of the product but utilizes a packaging material already present to also provide the added advantage of better raw stock keeping of the material in the package. Even when moisture or solvent saturation of the molecular sieves of the. invention occurs, the structural products will maintain their integrity, as well as being conductive and providing static protection to the materials. The invention also has the advantage that the reduction in moisture during storage will improve the raw stock keeping of a photographic film by increasing the glass transition temperature of the gelatin emulsion due to the reduced moisture content. These and other advantages will be apparent from the description below.

The zeolites utilized in the invention may be added to any suitable paper or fiber that will provide sufficient strength to the package. Further, the paper should be nonphotographically active and not give off any materials that would be harmful photographically. The paper preferably is free or substantially free of ligand and sulfur. It preferably is a pH with neutral alkaline range and contains an alkaline buffer such as calcium carbonate. It may be preferable when protein based materials are to be stored in or maintained next to the layer that alkaline buffers not be on the surface. The zeolite of the invention is mixed with the paper fibers and may be formed in any conventional paper or linerboard forming machine in which a slurry of fibers is placed onto a foraminous member such as a fourdrinier wire to drain, and then the sheet is subject to further water removal steps between felts and dryer drums. The paper may be formed in a machine with the head box that releases multiple streams for formation of a paper that has a different surface structure from the interior.

In the storage of photographic materials, it is important that the relative humidity be maintained at a low percent of moisture content, as the gelatin which contains the image materials exhibits a variety of glass transition temperatures depending on the amount of retained moisture due to the surrounding relative humidity of the air in equilibrium. Photothermographic films, particularly in the large size sheets of 14"×17" where these materials are used, are also subject to humidity differences across the transverse direction of the sheet. It is desirable that the moisture content at the edges be close to that at the center of the sheet. Having constant humidity decreases sensitivity of this film to temperature. Temperature sensitivity will result in different photographic performance depending on the temperature humidity relationship. The moisture and solvent absorption by the zeolites will increase the glass transition temperature of the poly(vinyl butyral) polymer. The resulting increase in glass transition temperature will prevent rapid deterioration of the film performance due to hydrolysis. By hydrophilic zeolite, it is meant that the zeolite will absorb between 18 and 24% its weight in water. Further, hydrophilic zeolites of the invention will absorb between about 15 and about 35% of their weight in acids. Further, they also will have solvent absorption properties of about 15 and 30 percent by weight.

Any suitable hydrophilic molecular sieve zeolite such as, for example, Type A, Type L, Type X, Type Y, and mixtures of these zeolites may be used in this invention. In the practice of this invention the two hydrophilic types, A and X, are preferred. Molecular sieve, zeolites contain in each crystal interconnecting cavities of uniform size, separated by narrower openings, or pores, of equal uniformity. When formed, this crystalline network is full of water, but with moderate heating, the moisture can be driven from the cavities without changing the crystalline structure. This leaves the cavities with their combined surface area and pore volume available for absorption of water or other materials. The process of evacuation and refilling the cavities may be repeated indefinitely under favorable conditions.

With molecular sieves, close process control is possible because the pores of the crystalline network are uniform rather than of varied dimensions, as is the case with other adsorbents. With the large surface area and pore volume, molecular sieves can make separations of molecules, utilizing pore uniformity, to differentiate on the basis of molecular size and configuration.

Molecular sieves are crystalline, metal aluminosilicates with three dimensional network structures of silica and alumina tetrahedra. This very uniform crystalline structure imparts to the molecular sieves properties which make them excellent desiccants, with a high capacity even at elevated temperatures. The tetrahedra are formed by four oxygen atoms surrounding a silicon or aluminum atom. Each oxygen has two negative charges and each silicon has four positive charges. This structure permits a sharing arrangement, building tetrahedra uniformly in four directions. The trivalency of aluminum causes the alumina tetrahedron to be negatively charged, requiring an additional cation to balance the system. Thus, the final structure has sodium, potassium, calcium or other cations in the network. These charge balancing cations are the exchangeable ions of the zeolite structure.

In the crystalline structure, up to half of the quadrivalent silicon atoms can be replaced by trivalent aluminum atoms. Zeolites containing different ratios of silicon to aluminum ions are available, as well as different crystal structures containing various cations.

In the most common commercial zeolite, Type A, the tetrahedra are grouped to form a truncated octahedron with a silica or alumina tetrahedron at each point. This structure is known as sodalite cage.

When sodalite cages are stacked in simple cubic forms, the result is a network of cavities approximately 11.5 Å in size, accessible through openings on all six sides. These openings are surrounded by eight oxygen ions. One or more exchangeable cations also partially block the face area. In the sodium form, this ring of oxygen ions provides an opening of 4.2 Å in diameter into the interior of the structure. This crystalline structure is represented chemically by the following formula:

$$Na_{12}[(AlO_2)_{12}(SiO_2)_{12}]\times H_2O$$

The water of hydration which fills the cavities during crystallization is loosely bound and can be removed by moderate heating. The voids formerly occupied by this water can be refilled by adsorbing a variety of gases and liquids. The number of water molecules in the structure (the value of X) can be as great as 27.

The sodium ions, which are associated with the aluminum tetrahedra, tend to block the openings, or conversely may assist the passage of slightly oversized molecules by their electrical charge. As a result, this sodium form of the molecular sieve, which is commercially called 4 A, can be regarded as having uniform openings of approximately 4 Å diameter.

Because of their base exchange properties, zeolites can be readily produced with other metals substituting for a portion of the sodium.

Among the synthetic zeolites, two modifications have been found particularly useful in industry. By replacing a large fraction of the sodium with potassium ions, the 3 A molecular sieve is formed (with openings of about 3 Å). Similarly, when calcium ions are used for exchange, the 5 A (with approximately 5 Å openings) is formed.

The crystal structure of the Type X zeolite is built up by arranging the basic sodalite cages in a tetrahedral stacking (diamond structure) with bridging across the six-membered oxygen atom ring. These rings provide opening 9–10 Å in diameter into the interior of the structure. The overall electrical charge is balanced by positively charged cation(s), as in the Type A structure. The chemical formula that represents the unit cell of Type X molecular sieve in the soda form is shown below:

$$Na_{86}[(AlO_2)_{86}(SiO_2)lO_6]XH_2O$$

As in the case of the Type A crystals, water of hydration can be removed by moderate heating and the voids thus created can be refilled with other liquids or gases. The value of X can be as great as 276. A value of X between 10 and 35 is preferred for good solvent and water absorption.

A prime requisite for any adsorbent is the possession of a large surface area per unit volume. In addition, the surface must be chemically inert and available to the required adsorbate(s). From a purely theoretical point of view, the rate at which molecules may be adsorbed, other factors being equal, will depend on the rate at which they contact the surface of adsorbent particles and the speed with which they diffuse into particles after contact. One or the other of these factors may be controlling in any given situation. One way to speed the mass transfer, in either case, is to reduce the size of the adsorbent particles.

While the synthetic crystals of zeolites are relatively small, e.g., 0.1 $\mu$m to 10 $\mu$m, these smaller particles may be bonded or agglomerated into larger shapes. Typical commercial spherical particles have an average bonded particle size of 1000 $\mu$m to 5000 $\mu$m (4 to 12 mesh). Other molecular sieve shapes, such as pellets (1–3 mm diameter), Rashig rings, saddles, etc., are useful.

The molecular sieve should be employed as received from the manufacture which is in the most dry conditions. If the molecular sieve has been exposed to the atmosphere, it is preferred that it be reactivated according to manufacturer's recommendations.

The molecular zeolite generally is in powder form when incorporated into the wood fibers. However, there might be instances when a molecular sieve may be somewhat larger than powder such as pellets.

The molecular sieve material may be incorporated in any suitable amount. Generally when the molecular sieve zeolite of a particle size of between 0.1 and 10 $\mu$m average diameter is utilized, the zeolite material can be present in any effective amount up to about 4 percent by weight of the paperboard and still provide adequate structural properties for use in photographic. A suitable amount of molecular sieve material is between 20 and 40 weight percent of the total weight of the paperboard. The amount can be varied depending on the mechanical requirement of the paperboard member. A preferred amount of zeolite incorporation is between about 25 and 35 percent by weight of the paperboard for good absorption of water vapor and other vapors with preservation of the properties of the photothermographic film.

The fiber boards of the invention typically will have a basis weight of between about 0.7 kg/m$^2$ and 0.3 kg/m$^2$ A preferred basis weight is between 0.44 and 0.52 kg/m$^2$ for structural properties that will protect the film in the package, as well as providing sufficient zeolite to maintain humidity control. Typically the fiber board having between 25 and 35 percent of zeolite by weight is utilized in an amount such that the fiber board utilized in packaging has a weight of between about 3 and 8 percent of the weight of the photographic material. Typically the liner board utilized in the invention is in the form of a folder such that it is slightly larger than the stack of sheets of film being packaged and has a protective sheet on the top and bottom, as well as extending along one side. This provides adequate protection without complicated packaging or waste of material.

It has been found that the materials of the invention result in exceptionally uniform humidity control of the materials being packaged. Even in the center of the package, the sheets are of a humidity and solvent content similar to those at the edges near the zeolite containing paperboard of the invention. Film packaged without a solvent and humidity controlling hydrophilic zeolite paperboard will have different moisture and solvent contents vertically and horizontally within the package of the film leading to nonuniform photographic performance.

The paper or paperboard containing zeolite of the invention also may be provided with other active materials. The paper may also contain activated charcoal, activated carbon, or other similar carbon-containing absorbent materials. It is also possible to use an inorganic absorbent such as silica, activated alumina, or clay. The addition of these materials will aid in absorption of other materials which may be present in the packaging. As the photothermographic film contains a polymer matrix in which the photoactive ingredient is present, the polymer may give off solvents which can be absorbed both by the zeolite, clay, and activated charcoal. While the invention has been discussed with respect to film that is packaged in a plastic bag, the materials of the invention also could be utilized with photothermographic films that are packaged in materials such as plastic-lined boxes and canisters. Such film also could be packaged with the linerboard to both protect it from physical damage, as well as deterioration by changes in humidity or solvent deterioration.

The fiber board of the invention containing hydrophilic zeolite is generally stable and, therefore, does not significantly shed fibers or zeolite particles which will become contaminants on the film and have a deleterious effect upon images formed on the photothermographic film.

The following examples illustrate the practice of this invention. They are not intended to be exhaustive of all possible variations of the invention. Parts and percentages are by weight unless otherwise indicated.

EXAMPLES

A Molecular Sieve Type 4A hydrophilic zeolite was obtained from UOP—Molecular Sieve Division, Inc. The zeolite has a chemical composition of sodium aluminosilicate and has an average particle size of about 5 $\mu$m. A hydrophobic zeolite with a [particle size] 5 $\mu$m was also obtained from FiberMark, Inc., 44 Old Princeton Road, Fitchburg, MA 01420. Three samples are then formed, one utilizing the molecular sieve type 13X hydrophilic zeolite, another utilizing the hydrophobic zeolite of the prior art, and a third not containing zeolite. Samples (1) without zeolite, (2) with hydrophobic zeolite, and (3) with hydrophilic zeolite were then compared to see their effect upon photothermographic film during storage. Sample 4 is the control for no aging and is tested prior to incubation. Samples 1, 2, and 4 are controls, and Sample 3 is the invention. The sheets are prepared by forming a slurry of wood fiber of alkaline paper, and dispersing the slurry in water. The diluted and dispersed slurry was then placed in a sheet mold. This sheet mold had a wire mesh screen at its base. The slurry in the sheet hold was mildly agitated, and the sheet mold was then drained. As the water drained through the wire mesh screen, the fiber and the adsorbent and/or buffer was collected as a mat on the screen. Next, a blotter was placed on the resulting wet fiber mat in order to remove excess water. The blotter was then used to peel the fiber mat away from the wire mesh screen. Next, the mat was sandwiched between two cloth felts and mechanically pressed to remove water. The pressed mat was then dried on a dryer can to form a sheet having a moisture content of between 5 and 10 percent. The two samples having the zeolite were prepared according to the above procedure. Each of the samples containing zeolite contain 30% by weight of the zeolite. These boards have a basis weight of about 0.52 kg/m$^2$. A sheet of each of the prepared materials was utilized and packaging in a standard pack of photothermograpahic medical imaging film. The pack is vacuum sealed, foil trade pack of 100 14"×17" sheets of silver behemite type photothermograhic medical imaging film. Three packs are formed with the cardboard on the top and bottom of the stack, as well as along one edge. The sealed trade packs were then incubated for two weeks at 100° F. (38° C.) temperature. They were then given a laser sensitometry exposure and processed on a drum type thermal processor to access changes in imaging response brought by incubation. The boards did not show any photo activity detrimental to the films. The Table 1 below illustrates the results of testing. Table 1 shows the 5 results of 2-week Incubation of 2 packages of each sample at 70° F. (21° C.) It also shows a Control Sample 4 tested prior to any incubation. Each sample was divided prior to packaging and one part preconditioned 72 hours at 70° F. (21° C.) and at 15%, relative humidity, and the second part at 60% relative humidity at 70° F. (21° C.) for 72 hours. The samples were then packaged and tested. After incubation, exposure and processing Gross Fog, Upper scale contrast, Upper density point and speed were measured for sheets 1, 20, 50, and 90 of each pack. The average of the number for the measured sheets appears in Table 1.

TABLE 1

| Sensitometric Features | *Sample No. | At 15% RH 100° F. (38° C.) | At 60% RH 100° F. (38° C.) |
|---|---|---|---|
| Gross Fog | 4 | 0.433 | 0.478 |
| Upper Scale Contrast | 4 | 2.100 | 2.030 |
| Upper Density Point | 4 | 3.660 | 3.650 |
| Speed | 4 | 97 | 91 |
| Gross Fog | 1 | 0.448 | 0.512 |
| Upper Scale Contrast | 1 | 1.74 | −0.520 |
| Upper Density Point | 1 | 3.410 | 2.85 |
| Speed | 1 | 89 | 70 |
| Gross Fog | 2 | 0.453 | 0.444 |
| Upper Scale Contrast | 2 | 1.78 | −.490 |
| Upper Density Point | 2 | 3.43 | 2.410 |
| Speed | 2 | 84 | 54 |
| Gross Fog | 3 | 0.442 | 0.487 |
| Upper Scale Contrast | 3 | 1.730 | 1.880 |
| Upper Density Point | 3 | 3.400 | 3.5200 |
| Speed | 3 | 88 | 85 |

*Samples 1, 2, and 4 are Controls

As the review data in Table 1 show, the hydrophilic zeolites of the invention method exhibited properties close to the material of Sample 4 that were not incubated. Properties of films stored with the Example 3 hydrophilic zeolite linerboards of the invention after two weeks' storage as compared with both the plain stiffener board and the hydrophobic zeolite stiffener board of the prior art were much better. Particularly, in the instance of the high humidity conditioned film, the properties were much improved as compared with the control examples. The invention exhibits less advantage with film that is low humidity conditioned prior to storage.

The invention has been described in detail with particular reference to preferred embodiments thereof, but it will be understood that variations and modifications can be effected within the spirit and scope of the invention.

What is claimed is:

1. A method of improving raw stock keeping of silver containing imaging material comprising providing a package of raw stock imaging material and providing in said package a fiber board containing clay and 20 to 40% by weight hydrophilic zeolite.

2. The method of claim 1 wherein said zeolite comprises the crystalline structure represented chemically by the following formula:

$$Na_{12}[(AlO_2)_{12}\{SiO_2)_{12}\}XH_2O$$

wherein the water of hydration which fills the cavities during crystallization is loosely bound and can be removed by moderate heating and the number of water molecules (X) in the structure is between 1 and 276.

3. The method of claim 1 wherein said package is a moisture proof, heat sealed bag.

4. The method of claim 1 wherein said fiber board further comprises activated carbon.

5. The method of claim 1 wherein said fiber board comprises 25–35 percent zeolite.

6. The method of claim 1 wherein said fiber board has a weight of about 5 percent of the weight of said imaging material.

7. The method of claim 1 wherein said zeolite absorbs solvents and airborne reducing agents.

8. The method of claim 2 where X is between 10 and 35.

9. The method of claim 1 wherein said hydrophilic zeolite will absorb between 25 and 35 percent of its weight in water.

10. The method of claim 1 wherein said silver containing imaging material comprises photothermographic film.

11. The method of claim 1 wherein said fiber board protects said imaging material from edge deterioration.

12. The method of claim 10 wherein said fiber board is not photographically active.

13. The method of claim 1 wherein said fiber board is not photographically active.

* * * * *